US007628352B1

(12) United States Patent
Low et al.

(10) Patent No.: US 7,628,352 B1
(45) Date of Patent: Dec. 8, 2009

(54) MEMS CONTROL SURFACE FOR PROJECTILE STEERING

(76) Inventors: Richard Low, 910 Jefferson St., Apt. 2, Alexandria, VA (US) 22314; Michael Deeds, 6525 Chelsea Way, Port Tobacco, MD (US) 20677; Daniel L. Jean, 8730 Orchard Green Ct., Odenton, MD (US) 21113; Christopher Hovland, 1052 Chesapeke Ct., Waldorf, MD (US) 20602

( * ) Notice: Subject to any disclaimer, the term of this patent is extended or adjusted under 35 U.S.C. 154(b) by 146 days.

(21) Appl. No.: 11/268,401

(22) Filed: Nov. 1, 2005

(51) Int. Cl.
*F42B 15/01* (2006.01)

(52) U.S. Cl. ..... 244/3.21; 244/99.8

(58) Field of Classification Search ..... 244/99.8
See application file for complete search history.

(56) References Cited

U.S. PATENT DOCUMENTS 1,855,349 A * 4/1932 Hammond, Jr. ..... 114/24
2,060,198 A * 11/1936 Hammond, Jr. ..... 114/21.2
3,430,536 A * 3/1969 Oelrich ..... 91/47
3,711,039 A * 1/1973 James ..... 244/214
4,075,930 A * 2/1978 Millett ..... 91/361
4,687,159 A * 8/1987 Kageorge ..... 244/134 A
4,838,502 A * 6/1989 Pinson ..... 244/49
4,865,291 A * 9/1989 Briscoe et al. ..... 251/30.02
5,154,373 A * 10/1992 Scott ..... 244/117 R
5,288,355 A * 2/1994 Leffel et al. ..... 156/156
5,314,145 A * 5/1994 Rauckhorst, III ..... 244/134 A
5,558,304 A * 9/1996 Adams ..... 244/134 A
5,562,265 A * 10/1996 Rauckhorst, III ..... 244/134 R
5,631,830 A * 5/1997 Schroeder ..... 701/4
6,105,904 A 8/2000 Lisy et al.
6,283,407 B1 9/2001 Hakenesch
6,302,360 B1 10/2001 Ng
6,367,735 B1 * 4/2002 Folsom et al. ..... 244/3.22
6,419,189 B1 * 7/2002 DiChiara et al. ..... 244/123.1
6,439,505 B1 * 8/2002 Hyde et al. ..... 244/134 A
6,443,394 B1 * 9/2002 Weisend, Jr. ..... 244/134 A
6,474,593 B1 11/2002 Lipeles et al.
6,520,452 B1 * 2/2003 Crist et al. ..... 244/134 A
6,676,077 B1 * 1/2004 DiChiara et al. ..... 244/117 R
6,685,143 B1 2/2004 Prince et al.
6,727,485 B2 * 4/2004 Rastegar et al. ..... 244/3.1
6,752,351 B2 * 6/2004 John ..... 244/3.22
6,786,457 B2 * 9/2004 Dockter et al. ..... 244/219
6,889,935 B2 * 5/2005 O'Dwyer ..... 244/3.21

(Continued)

OTHER PUBLICATIONS

"Application of MEMS Devices to Delta Wing Aircraft: From Concept Development to Transonic Flight Test" Huang, Adam, et al., 39th AIAA Aerospace Sciences Meeting & Exhibit, Jan. 8-11, 2001, Reno, Nevada, AIAA-2001-0124.*
"About TST" Elwenspoek, Miko, Sep. 2004 http://tst.ewi.utwente.nl/abouttst/index.html.*

(Continued)

*Primary Examiner*—Michael R Mansen
*Assistant Examiner*—Joseph W Sanderson
(74) *Attorney, Agent, or Firm*—Fredric J. Zimmerman

(57) ABSTRACT

A projectile includes a projectile body including a flow surface; the flow surface including at least one control surface formed therein. The controls surface is formed continuous with the flow surface, and a pressure source is connected to at least one control surface. The pressure source delivers a pressure to at least one control surface to cause at least one control surface to bulge away from the flow surface.

18 Claims, 2 Drawing Sheets

U.S. PATENT DOCUMENTS

| | | | | |
|---|---|---|---|---|
| 6,910,661 | B2 * | 6/2005 | Dockter et al. | 244/218 |
| 6,935,242 | B2 * | 8/2005 | Rastegar et al. | 102/501 |
| 7,004,423 | B2 * | 2/2006 | Folsom et al. | 244/3.22 |
| 2003/0122037 | A1 * | 7/2003 | Hyde et al. | 244/134 A |

OTHER PUBLICATIONS

"Flexible Shear-Stress Sensor Skin and Its Application to Unmanned Aerial Vehicles" Xu,Yong, et al., May 6, 2003, Science Direct, A 105 (2003) 321-329.*

* cited by examiner

MEMS CONTROL SURFACE FOR PROJECTILE STEERING

STATEMENT OF GOVERNMENT INTEREST

The invention described herein may be manufactured and used by or for the Government of the United States of America for government purposes without the payment of any royalties thereof.

BACKGROUND OF THE INVENTION

The invention relates in general to devices for steering projectiles and in particular to micro-electromechanical systems (MEMS) type control surfaces for steering projectiles.

Conventional control systems rely on actuators to rotate fins to provide flight path control. These fins protrude far into the flow stream and require actuators that provide sufficient torque to maintain the fins in the desired orientation. MEMS have been demonstrated for flight control on delta wings. Small perturbations in the flow field created by MEMS structures can result in a net macro force with sufficient strength to steer large objects.

U.S. Pat. No. 6,105,904 discloses deployable flow control devices. FIGS. 15 and 16 of that patent show two embodiments in which a sealable, flexible element acts as a flow effector. FIG. 15 shows the sealable, flexible element in the quiescent state while FIG. 15A shows it in the deformed state. The sealable, flexible element secures to the housing under lip. When plenum is not pressurized the sealable, flexible element is in its quiescent state, retracted out of the fluid boundary layer on the flow surface and within the housing. When the plenum is pressurized, the sealable, flexible element changes to its deformed state expanding such that it deploys through aperture into the fluid boundary layer on the flow surface. When the plenum is depressurized, the sealable, flexible element returns to its quiescent state and retracts out of the fluid boundary layer on the flow surface. FIGS. 16 and 16A show the sealable, flexible element attached to the flow surface rather than the housing.

One problem with the device disclosed in U.S. Pat. No. 6,105,904 is that the flow effector is a separate piece that must be attached in some manner to the projectile flow surface or skin. At high velocities, such as Mach 2 to Mach 10, the temperature of the projectile flow surface increases to several hundred degrees Centigrade, which causes weakness at areas where the flow effector is attached to the flow surface. Another problem is using a polymer as the material for the flow effector. At high velocities and temperatures, the polymer is too elastic and unstable. Still another problem is that, in the embodiment of FIG. 15, the flow effector is not flush with the flow surface, thereby creating a flow disturbance when the flow effector is in the "inactive" position. Similarly, in the embodiment of FIG. 16, the flow effector projects above the flow surface even in the "inactive" position.

Unexpectedly, Applicant has discovered a novel structural arrangement to overcome the above limitations.

SUMMARY OF THE INVENTION

The present invention overcomes the problems of the conventional technology by providing a control surface that is formed continuous with the surrounding flow surface. Therefore, there is no separate piece that must be attached to the flow surface. Eliminating the separate piece eliminates the possibility that the separate piece may become detached or weakened at high velocities and temperatures. In addition, the control surface will be flush with the flow surface in the "inactive" position thereby eliminating unwanted flow disturbances. Furthermore, the inventive control surface is made of the same material as the surrounding flow surface so that its elasticity and high temperature stability is suitable for high velocities and temperatures.

An object of the invention is to guide hypersonic projectiles, without adversely affecting the projectile drag coefficient.

Another object of the invention is to provide a control surface that consumes minimal power and volume.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

In accordance with the invention, MEMS control surfaces and, in an embodiment, the control surface is a diaphragm structure, are formed continuous with the flow surface of a projectile so as to be intergrated with the flow surface in order to alter the flow field around the projectile. By applying a pressure stimulus to a MEMS diaphragm, the changes in the flow field result in changes in drag and lift that can be used to steer the projectile. The invention is particularly useful for projectiles traveling at hypersonic velocities. At hypersonic velocities, only a very small protuberance into the flow field is needed to influence the direction of flight. Even deflections as small as 40 μm can have a significant effect on the flow field.

The MEMS control surfaces may be located directly on the projectile, or on the fins of the projectile. The pressure may be supplied to the control surfaces via an actuator, or harnessed from the flow field. The MEMS control surfaces have, in essence, no moving parts. As result, the system will share benefits enjoyed by other solid-state systems, such as elimination of friction and wear and greater repeatability. In addition, MEMS batch fabrication processes generally result in dramatically reduced cost. The invention reduces volume and power requirements. The low profile structures have less drag than conventional systems, which results in a longer projectile range and reduced heating.

Figure 1A:
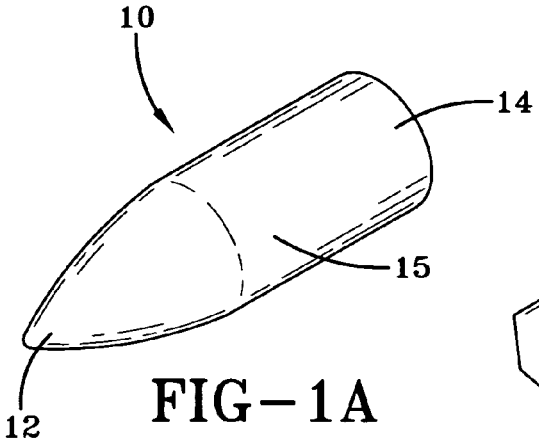
FIG. 1A shows a projectile.
Figure 1B:
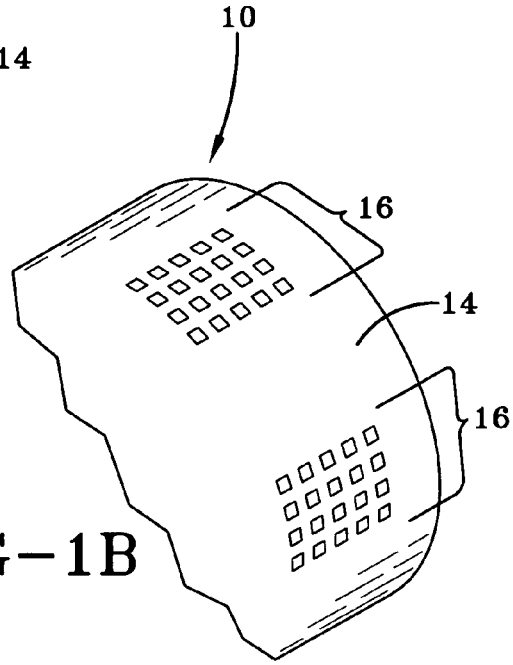
FIG. 1B is an enlarged view of a portion of the projectile of FIG. 1A.
Figure 2A:
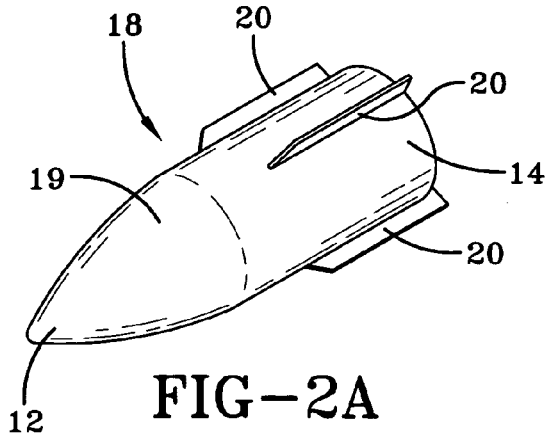
FIG. 2A shows another projectile.
Figure 2B:
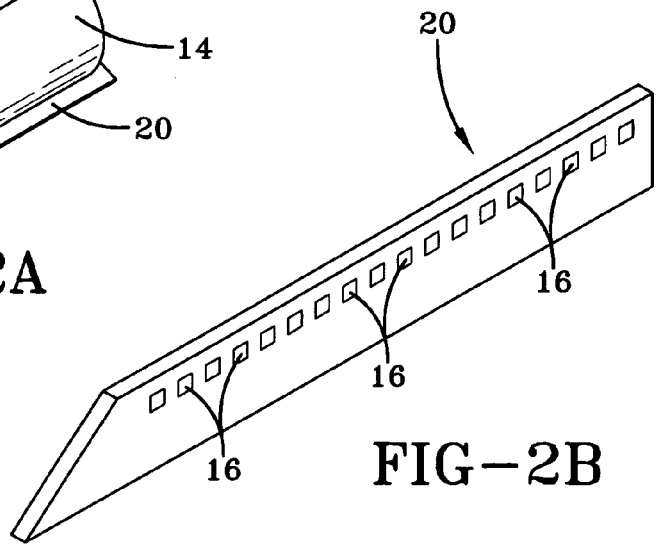
FIG. 2B is an enlarged view of a portion of the projectile of FIG. 2A.

FIG. 1A shows a projectile 10 having a nose 12, a tail end 14 and a flow surface 15. Flow surface 15 comprises the outer skin of projectile 10. FIG. 1B is an enlarged view of the tail end portion 14 of the projectile 10 of FIG. 1A. Two arrays of control surfaces or diaphragms 16 are shown. Each array includes a plurality of diaphragms 16. FIG. 2A shows another projectile 18 having a nose 12, a tail end 14 and fins 20. The flow surface 19 comprises the outer skin of projectile 18 and fins 20. FIG. 2B is an enlarged view of a fin 20 of the projectile 18 of FIG. 2A. Fin 20 includes a plurality of control surfaces or diaphragms 16.

Figure 3A:
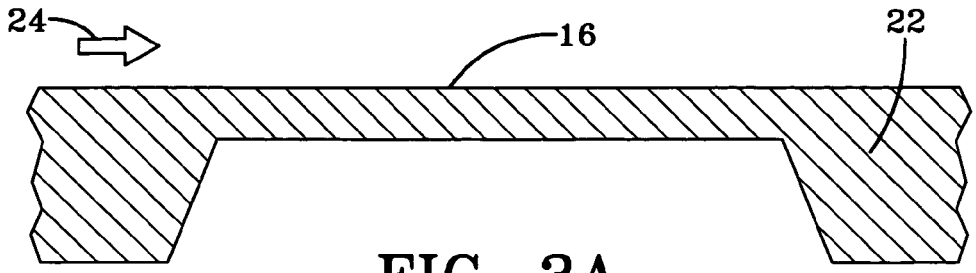
FIGS. 3A and 3B are sectional views of a control surface according to the invention.
Figure 3B:
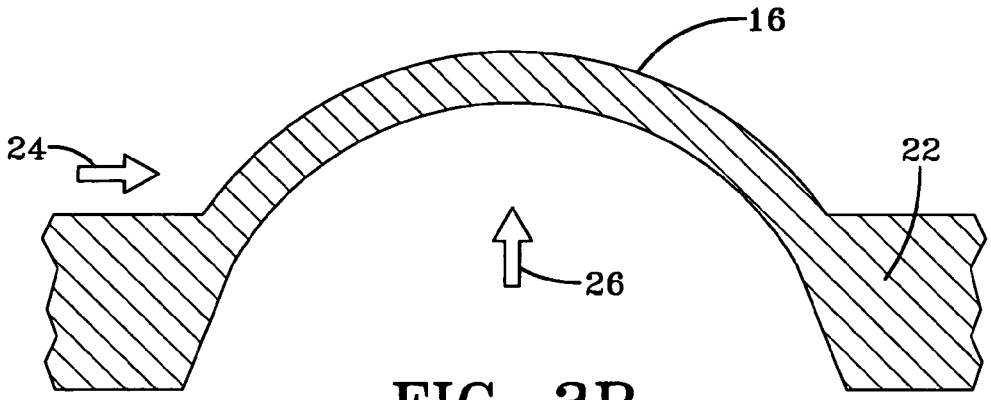
Figure 4:
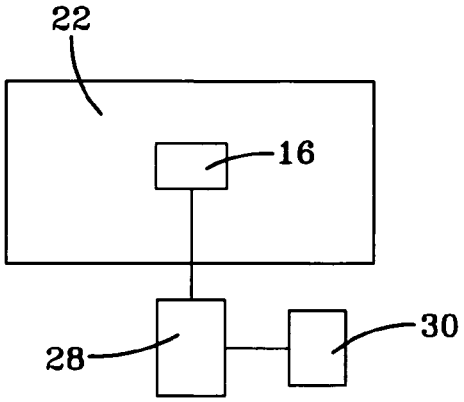
FIG. 4 is a schematic of one embodiment of the invention.

FIGS. 3A and 3B are sectional views of a control surface and, in an embodiment; the control surface is a diaphragm structure, 16. According to the invention. FIG. 3A shows the flow surface 22 of a projectile. Flow surface 22 may be the outer skin or fin of a projectile. Arrow 24 represents airflow over the flow surface 22. A control surface, for example, a diaphragm, 16 is continuously formed with the flow surface 22 so as to be integrated with the flow surface 22. In FIG. 3A, the control surface 16 (sometimes referred to herein as "diaphragm") is in an inactive state wherein the external surface of diaphragm 16 is flush with the external surface of flow surface 22. In FIG. 3B, pressure, represented by arrow 26, has been applied to diaphragm 16, which is a flexible, moveable structure, to cause it to bulge outward from flow surface 22, thereby influencing the flight path of the projectile. The deflection of the diaphragm 16 is in a range of 40 microns-1, 000 microns.

A thickness of flow surface 22 is, for example, in a range of about 0.5 to about 7 millimeters. A thickness of the diaphragm 16 is, for example, in a range of about 10 microns to about 100 microns. The amount of deflection of diaphragm 16 from its rest state in FIG. 3A to its deflected state in FIG. 3B is, for example, in a range of about 20 microns to about one millimeter. The shape of diaphragm 16 in the plane of the flow surface 22 may vary. Generally, but without limitation, the shapes are circles or squares with a principal dimension in a range of about 1 millimeter to about five millimeters, which, in part, facilitate cycling of the control surfaces 16

Diaphragm 16 is formed of the same piece of material as flow surface 22. One way of forming diaphragm 16 is by thinning out the underside of the flow surface 22 by etching with, for example, an acid. The remaining portions of the underside of flow surface 22 would be masked to prevent any unwanted thinning. Flow surface 22 and diaphragm 16 are made of a material that can withstand the extremely high temperatures associated with high velocity (Mach 2-Mach 10) flow. Generally, the materials are metals, including titanium and stainless steel. Nonetheless, in an embodiment, a ceramic material, for example, silicon carbide may also be used.

Figure 5:
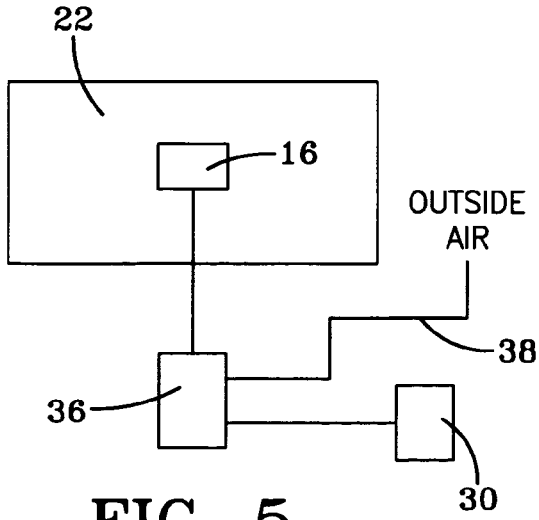
FIG. 5 is a schematic of a second embodiment of the invention.

FIG. 5 shows another way of controlling control surfaces 16. FIG. 5 shows the underside (or in the case of a fin, the inside) of flow surface 22 having a diaphragm 16 formed therein. An electronic valve 36 is connected to diaphragm 16 and supplies pressurized air to diaphragm 16. The pressurized air is fed to valve 36 via a pressure line 38, which extracts pressurized air from the external air flowing over projectile. Valve 36 is controlled by the guidance system 30 of the projectile. Each diaphragm 16 may have its own valve 36, or a plurality of diaphragms 16 may be served by a single valve 36 via a plenum arrangement. Valve 36 may also include a relief mechanism for relieving the pressure on diaphragms 16. Alternatively, a relief mechanism could be located in the fluid connection between the valve 36 and the diaphragm 16 with control established directly from the guidance system 30 or indirectly from the valve 36.

While the invention has been described with reference to certain preferred embodiments, numerous changes, alterations and modifications to the described embodiments are possible without departing from the spirit and scope of the invention as defined in the appended claims, and equivalents thereof.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A projectile, comprising:

a projectile body including a flow surface forming the outer skin of the projectile body;

the flow surface including at least one control surface formed therein, wherein said at least one control surface is formed continuous and integrated with the flow surface, a thickness of said at least one control surface is less than a thickness of the flow surface; and a pressure source connected to said at least one control surface, the pressure source delivering pressurized fluid to said at least one control surface to cause said at least one control surface to bulge outwardly away from the flow surface, wherein said at least one control surface is formed from a same material as the flow surface, and wherein the at least one control surface is a micro-electromechanical systems (MEMS) control surface.

2. The projectile of claim 1, wherein the flow surface comprises one of metal and ceramic.

3. The projectile of claim 2, wherein the flow surface comprises one of titanium and stainless steel.

4. The projectile of claim 2, wherein the flow surface comprises silicon carbide.

5. The projectile of claim 1, wherein the flow surface comprises a fin, said at least one control surface is formed in the fin.

6. The projectile of claim 1, wherein the pressure source comprises an actuator.

7. The projectile of claim 1, wherein said at least one control surface is a diaphragm structure.

8. The projectile of claim 1, wherein said at least one control surface comprises a plurality of control surfaces.

9. The projectile of claim 1, further comprising a relief mechanism connected to said at least one control surface for reducing pressure thereon.

10. A flow surface for a projectile, comprising:

a projectile body, wherein the flow surface forms the outer skin of the projectile body;

at least one control surface being formed in the flow surface, wherein said at least one control surface is formed continuous and integrated with the flow surface, a thickness of said at least one control surface is less than a thickness of the flow surface; and a pressure source connected to said at least one control surface, the pressure source delivering a pressure to said at least one control surface to cause said at least one control surface to bulge outwardly away from the flow surface of the projectile, wherein said at least one control surface is formed from a same material as the flow surface, and (MEMS) control surface.

11. The flow surface of claim 10, wherein said at least one control surface is a diaphragm structure.

12. The flow surface of claim 10, wherein said pressure is a pressurized fluid.

13. The flow surface of claim 10, wherein said pressure is pressurized air.

14. The flow surface of claim 10, wherein the flow surface is comprised of a material selected from one of titanium, stainless steel and silicon carbide.

15. The flow surface of claim 10, wherein the flow surface comprises a fin, said at least one control surface is formed in the fin.

16. The flow surface of claim 10, wherein the pressure source comprises an actuator.

17. The flow surface of claim 10, wherein said at least one control surface comprises a plurality of control surfaces.

18. The flow surface of claim 10, further comprising a relief mechanism connected to said at least one control surface for reducing pressure thereon.

* * * * *